United States Patent [19]

Wunsch

[11] Patent Number: 5,014,884

[45] Date of Patent: May 14, 1991

[54] SPRAY CONTAINER

[76] Inventor: Erich Wunsch, Forchenhalde 3, Bad Liebenzell, Fed. Rep. of Germany

[21] Appl. No.: 427,045

[22] Filed: Oct. 25, 1989

[30] Foreign Application Priority Data

Oct. 25, 1988 [DE] Fed. Rep. of Germany ..... 3836290
May 17, 1989 [DE] Fed. Rep. of Germany ..... 3916021

[51] Int. Cl.[5] ..... B65D 83/00; B05B 11/00; F04C 13/00

[52] U.S. Cl. ..... 222/333; 239/332; 239/333

[58] Field of Search ..... 222/333; 239/332, 333, 239/309

[56] References Cited

U.S. PATENT DOCUMENTS

| | | | |
|---|---|---|---|
| 3,768,732 | 10/1973 | Curtis et al. | 222/333 |
| 3,904,116 | 9/1975 | Jones et al. | 222/333 |
| 3,993,245 | 11/1976 | Smith | 239/309 |
| 4,160,525 | 7/1979 | Wagner | 239/332 |
| 4,618,099 | 10/1986 | Nagao et al. | 222/333 |
| 4,790,454 | 12/1988 | Clark et al. | 222/333 |

*Primary Examiner*—Andres Kasknikow

*Assistant Examiner*—Karen B. Merritt

*Attorney, Agent, or Firm*—Scully, Scott, Murphy & Presser

[57] ABSTRACT

A spray container or can which possesses a spray mechanism for finely atomizing fluids through the intermediary of a hydraulically-operating pump. Containers such as spray cans and spary bottles or flasks of the above-mentioned type generally known in commerce. Through the intermediary of mechanically actuatable pumps, in this instance there is sprayed a finely atomized fluid from a nozzle which is arranged on a housing of the container. The spary mechanism is inserted into a housing which is connectable with the supply container for the spray fluid or liquid through a close-fitted or frictional locking connection, and in which the spray mechanism incorporates an electromotively driven gear pump, and in which the suction line of the pump is conducted through an opening in the bottom of the housing into the supply container, the latter of which is equipped with a venting line, whereby the gear pump includes a delivery or pressure tube at its output end which is connected with a discharge nozzle.

17 Claims, 6 Drawing Sheets

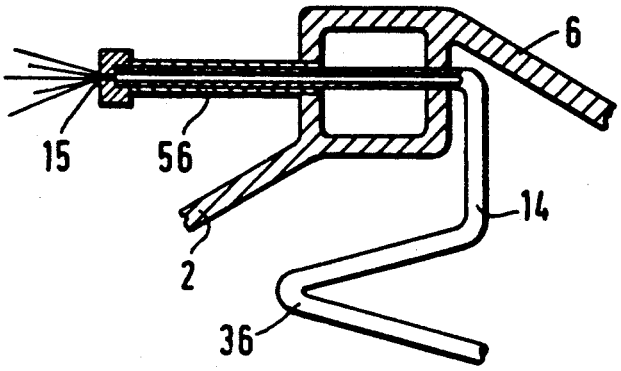
FIG. 5
FIG. 6
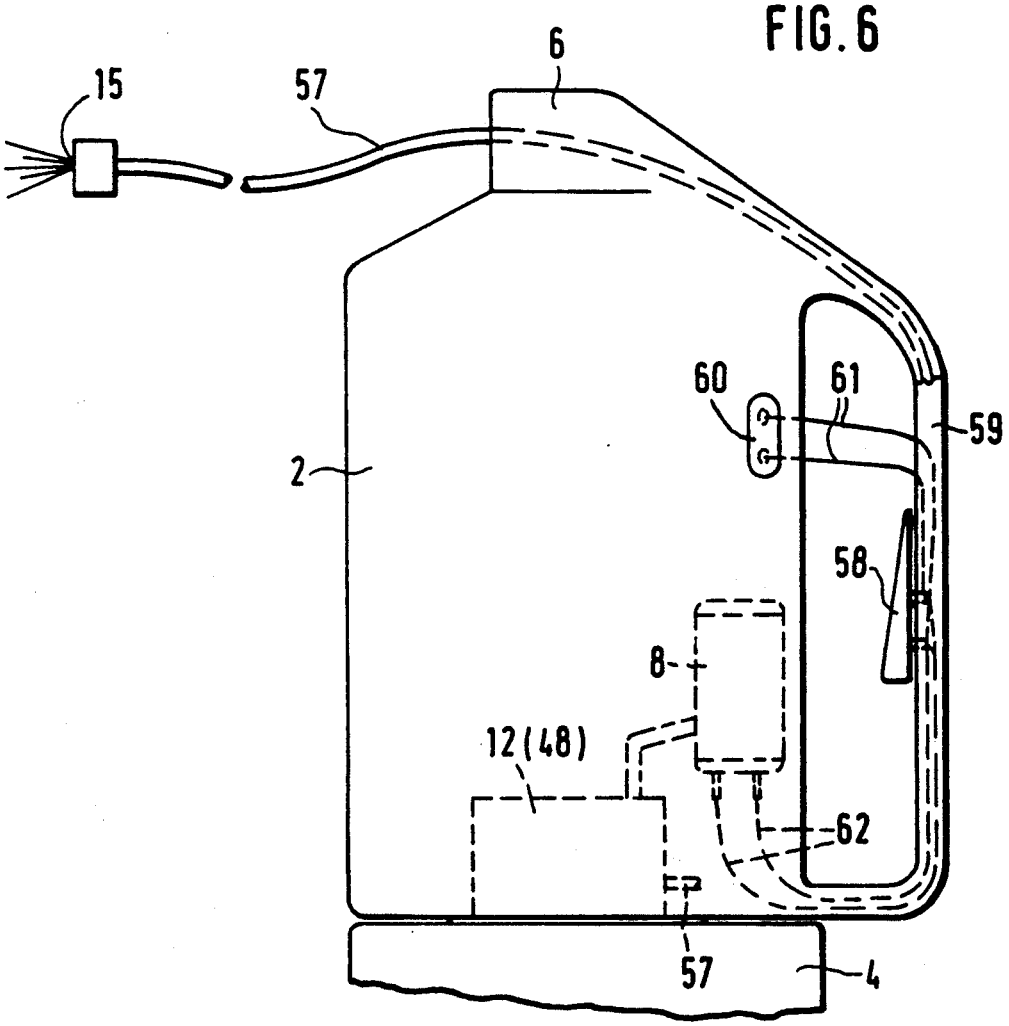

SPRAY CONTAINER

BACKGROUND OF THE INVENTION

1. Field of the Invention

The present invention relates to a spray container or can which possesses a spray mechanism for finely atomizing fluids through the intermediary of a hydraulically-operating pump. Containers such as spray cans and spray bottles or flasks of the above-mentioned type are generally known in commerce. Through the intermediary of mechanically actuatable pumps, in this instance there is sprayed a finely atomized fluid from a nozzle which is arranged on a housing of the container.

2. Discussion of the Prior Art

In accordance with an earlier German Patent Appln. P 38 29 674.8, the hydraulically-operating pump is electromechanically actuated through the intermediary of a gear motor, as a result of which there are avoided the noxious propellent gases. Besides any contamination of the environment, a further disadvantage of the heretofore known spray cans and spray bottles or flasks can be ascertained in that, subsequent to the withdrawal of the spray fluid, the entire spray can, together with the pump mechanism, the conduit or tube system and the discharge nozzle are discarded, as a consequence of which there are additionally destroyed reusable components which are capable of functioning.

SUMMARY OF THE INVENTION

Accordingly, it is an object of the present invention to improve upon the construction of a container, such as a spray can or flask, of the above-mentioned type in such a manner as to avoid the destruction of reusable components and in which any contaminations of the environment are reduced, and moreover, in which there is utilized a spray mechanism which will afford a satisfactory function for all possibly employable spray media, even during long-term operation.

Inventively, the foregoing object is achieved in that the spray mechanism is inserted into a housing which is connectable with the supply container for the spray fluid or liquid through a close-fitted or frictional locking connection, and in which the spray mechanism incorporates an electromotively driven gear pump, and in which the suction line of the pump is conducted through an opening in the bottom of the housing into the supply container, the latter of which is equipped with a venting line, whereby the gear pump includes a delivery or pressure tube at its output end which is connected with a discharge nozzle. Hereby, the gear pump can be fixedly mounted on the bottom of the housing.

Pursuant to a particular feature of the invention, a coupling can be connected intermediate the output shaft of the motor and the drive shaft of the gear pump.

In accordance with a still further feature of the invention, the venting line of the supply container can be closed off by a ball at its discharge end, in which the balls is subjected to the action of a spring in such a manner whereby a vacuum which is generated in the supply container during the withdrawal of fluid will overcome the spring force and displace the ball away from the discharge opening.

Furthermore, the gear pump can possess two equally-sized gears and, at the output or delivery end thereof, possess an overflow valve in the form of a spring-supported steel conduit.

Pursuant to another embodiment of the invention, the spray mechanism, in an alternative to the foregoing gear pump arrangement, can possess a piston pump which is electromotively drivable, wherein the suction line of the pump is conducted through an opening in the bottom of the housing into the fluid supply container, whereby the piston pump possesses a pressure or delivery tube at its output or discharge end, which is connected with a discharge nozzle. The opening in the bottom can basically be sealed off, and the pressure tube can be provided with a helical coil portion extending through a helix angle of at least 180°.

Furthermore, a special configuration is achieved when the discharge nozzle is inserted into a spray head which is connected externally of the housing and separated therefrom with a pressure tube which is conducted out of the housing. This signifies that a line extends away from the housing so that the discharge nozzle is only first located at the distal end of this line; for example, after a distance of a meter. Thereby, under various circumstances, it is also possible to intensively spray ceilings in apartments or living quarters or buildings, without encountering any problems. The outgoing line can be constructed so as to be flexible. Pursuant to a still further improved configuration, the housing or, in essence, the container can possess a handle or grip, in which the flexible spray line is at least partially conducted, and in which a switch is additionally installed which is electrically connected with an energy source and with the pump. Consequently, this will eliminate the switch on the spray head. Through the provision of a second socket plug on the container or, in essence, on the housing, there can be expediently connected an electrical line to the switch which is arranged in the grip. By means of the switch in the grip the electric pump can be placed into operation in a simple manner whereby, moreover, it is possible to provide a good guidance by the hand for the spray container or spray can. Arranged within the grip is the flexible spray line or conduit, as well as the electrical cable for the actuation of the electric motor for the pump.

The utilization of a gear pump provides the advantage that different kinds of fluids or liquids which possess differing viscosities and compositions can be securely conveyed. The driving of the gear pump is carried out in a simple manner through an electric motor with the interposition of a coupling. In order to prevent any overflowing of the spray fluid subsequent to the switching off of the gear pump, an overflow valve is introduced at the outlet or discharge end, which also serves as a safety valve for the pressure side of the pump. The spring which acts on the steel ball in the valve, can be adjustable in any usual manner. Besides the embodiment of the gear pump with two equally-sized and interdigitating gears as is illustrated in the drawing figures, there can also be utilized other configurations and embodiments; for example, with an internal gearing and and planetary or epicyclic gear. Furthermore, it is also within the scope of the invention that the gears possess a suitable gear tooth construction, preferably an involute gearing providing a more precisely metered fluid flow.

The ball valve which is inserted at the outlet or discharge end in the venting line, and which includes an adjustable spring, has the advantage that in conformance with the spray fluid or liquid which is withdrawn from the fluid supply container, there is automatically effectuated an infeed of air. The actuation of the ball valve is effected by the vacuum alone which is generated in the supply container during the withdrawal of fluid.

A particular advantage of the invention also resides in the combination of the upper housing with the entire spray mechanism and the supply container for the spray fluid which, for example, can be screwed-on thereto. In the together-coupled condition, the two housings form a single unit. After the withdrawal of the spray fluid from the supply container, the housing together with the spray mechanism is removed and simply connected with a new container containing a supply of fluid. The entire upper portion is retained in conjunction with the spray mechanism and is reusable.

BRIEF DESCRIPTION OF THE DRAWINGS

Reference may now be had to the following detailed description of exemplary embodiments of spray containers pursuant to the invention, taken in conjunction with the accompanying drawings; in which:

FIG. 5 illustrates a sectional view through a spray head with an externally located discharge nozzle;

FIG. 6 illustrates a spray container with a remotely located discharge nozzle and with a switch in an operating grip;

DETAILED DESCRIPTION

Figure 1:
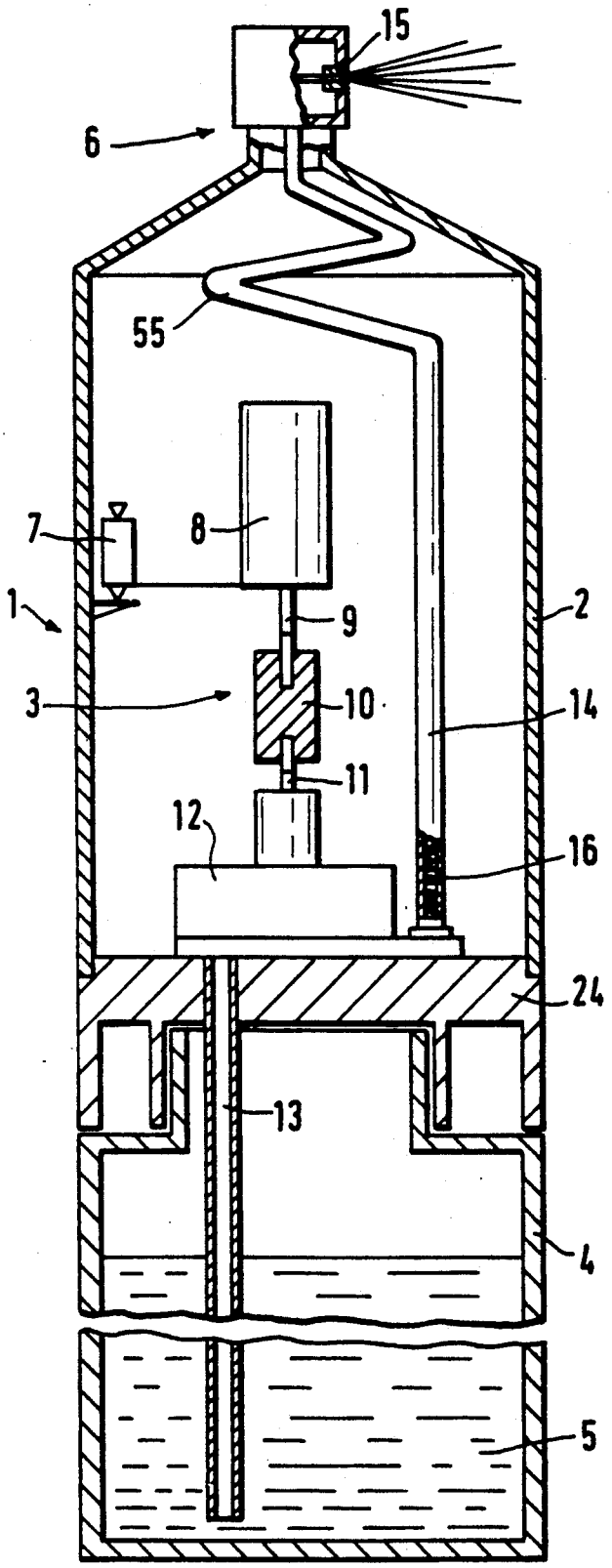
FIG. 1 illustrates a generally diagrammatic longitudinal sectional view through a spray container with a spray mechanism.

The spray can or container 1 essentially consists of a housing 2 for the receipt therein of the spray mechanism 3 and for a supply container 4 for the spray fluid or liquid 5, whereby the container 4 is detachably connected with the housing 2.

The housing 2 for the spray mechanism is cylindrically configured and possesses a head portion 6. The spray mechanism 3 consists of a battery 7, having an electric motor 8 electrically connected thereto. The electric motor 8 has its output shaft 9 connected with a coupling 10, into which there engages a drive shaft 11 of a gear pump 12. A suction line 13 exits below the gear pump 12, whereas a pressure or delivery tube 14 connects in the upper portion of the gear pump which communicates with the discharge or spray nozzle 15 located in the head portion 6 of the spray can or container. Arranged in the pressure tube 14 at the discharge side of the gear pump 12 is an overflow valve 16 with a ball 17 and an adjustable coil spring 18.

Figure 2:
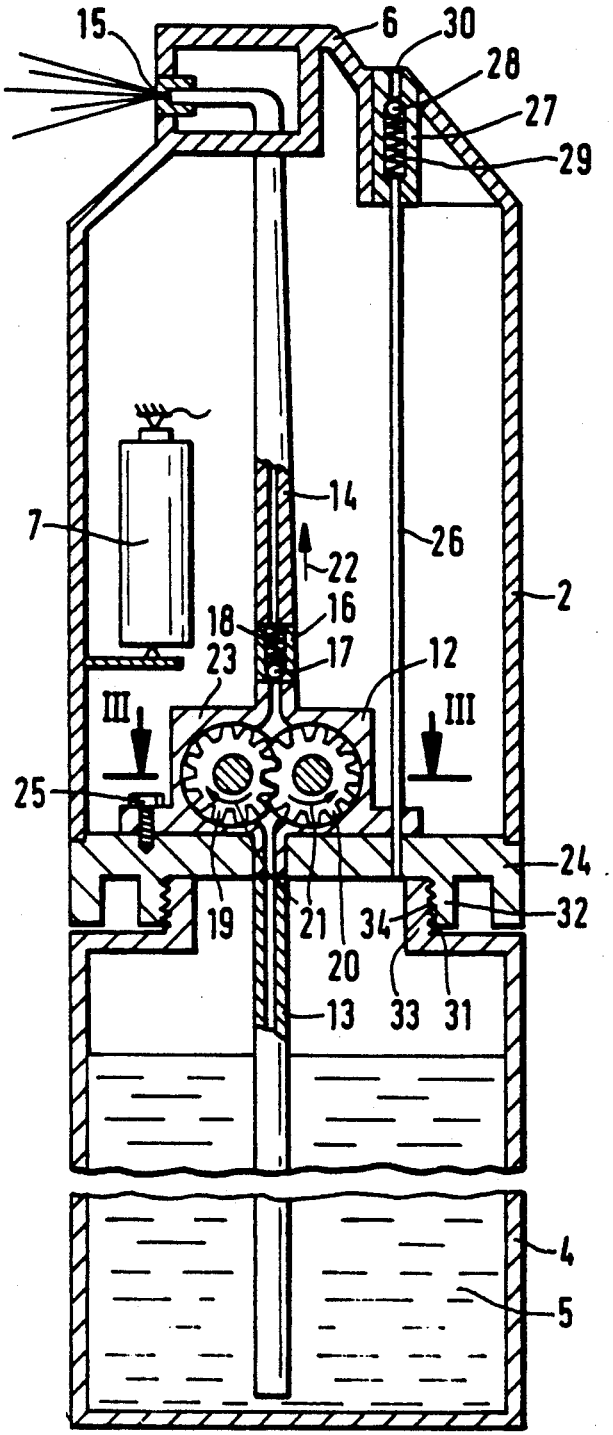
FIG. 2 illustrates the spray container pursuant to FIG. 1 with a gear pump being shown in section.
Figure 3:
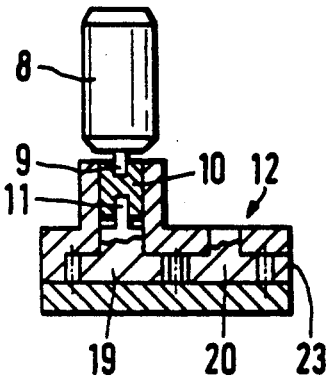
FIG. 3 illustrates a sectional view through the gear pump taken along line III—III in FIG. 2.

As can be ascertained from FIGS. 2 and 3, the gear pump 2 consists of two equally-sized gears 19 and 20, which are in engagement with each other. Upon the rotation of the two gears in the direction of arrow 21, spray fluid is aspirated from the suction line 13 and conducted through the open gaps between the gear teeth to the pressure tube 14 in the direction of the arrow 22.

The gears 19 and 20 can be formed with an involute gearing for a more precisely material fluid flow. In order to eliminate fluctuations in the flow rate, there can additionally be provided a compensation through multi-gear pumps, in which there is installed a middle or intermediate gear possessing an odd number of gear teeth. Moreover, there can also be installed gear pumps with internal gearing and a planetary or epicyclic gear.

The gear pump 12 is encompassed by a housing 23, which is mountable on the bottom 24 of the housing 2 by means of screws 25.

The supply container 4 for the spray fluid 5 which is screwed to the housing 2 by means of a central screwthread 31, possesses a venting line 26 which at the discharge end from the housing 2 is equipped with a valve 27. This valve consists of a ball 28 which is pressed by means of a spring 29 against the discharge opening 30. Hereby, the spring 29 is so configured that under a vacuum which is generated in the supply container upon the withdrawal of fluid, it will lose such an extent of spring force, so as to cause the ball 28 to fall back from the discharge opening 30 and allow for an inflow of air into the fluid supply container 4.

The connection of the housing 2 with the supply container 4 for the spray fluid 5 is effected at the bottom 24 of the housing 2, wherein there is provided a collar 32 which possesses an internal screwthread 31. The supply container 4 is also provided with a collar 33 at its head end, and which possesses an external screwthread 34 which stands in firm and sealing engagement with the internal screwthread 31.

The FIG. 4 illustrates again a spray container or can 1 which essentially corresponds to the spray container pursuant to FIGS. 1 and 2, and which possesses a housing 2 for the receipt of the spray mechanism 3 and a further container 4 for the spray fluid 5. The bottom piece 35 of the housing 2 possesses a central and inwardly-drawn collar 36 with an internal screwthread 31. The collar 36 closes upwardly by means of a bottom plate 37, which can be integrally or separately applied thereto, and which incorporates a central opening 38 for the through-passage of the suction tube 13. The opening 38 receives an annular or ring-shaped seal housing 39 with an inserted sealing band or sealing ring 40. Furthermore, in the bottom plate 37 there is provided an off-center opening 41 of relatively small cross-section, through which there passes the air tube 26 as a venting line. In this instance, there is no need for a separate sealing structure between the venting line 26 and the opening 41 in the bottom plate.

Figure 4:
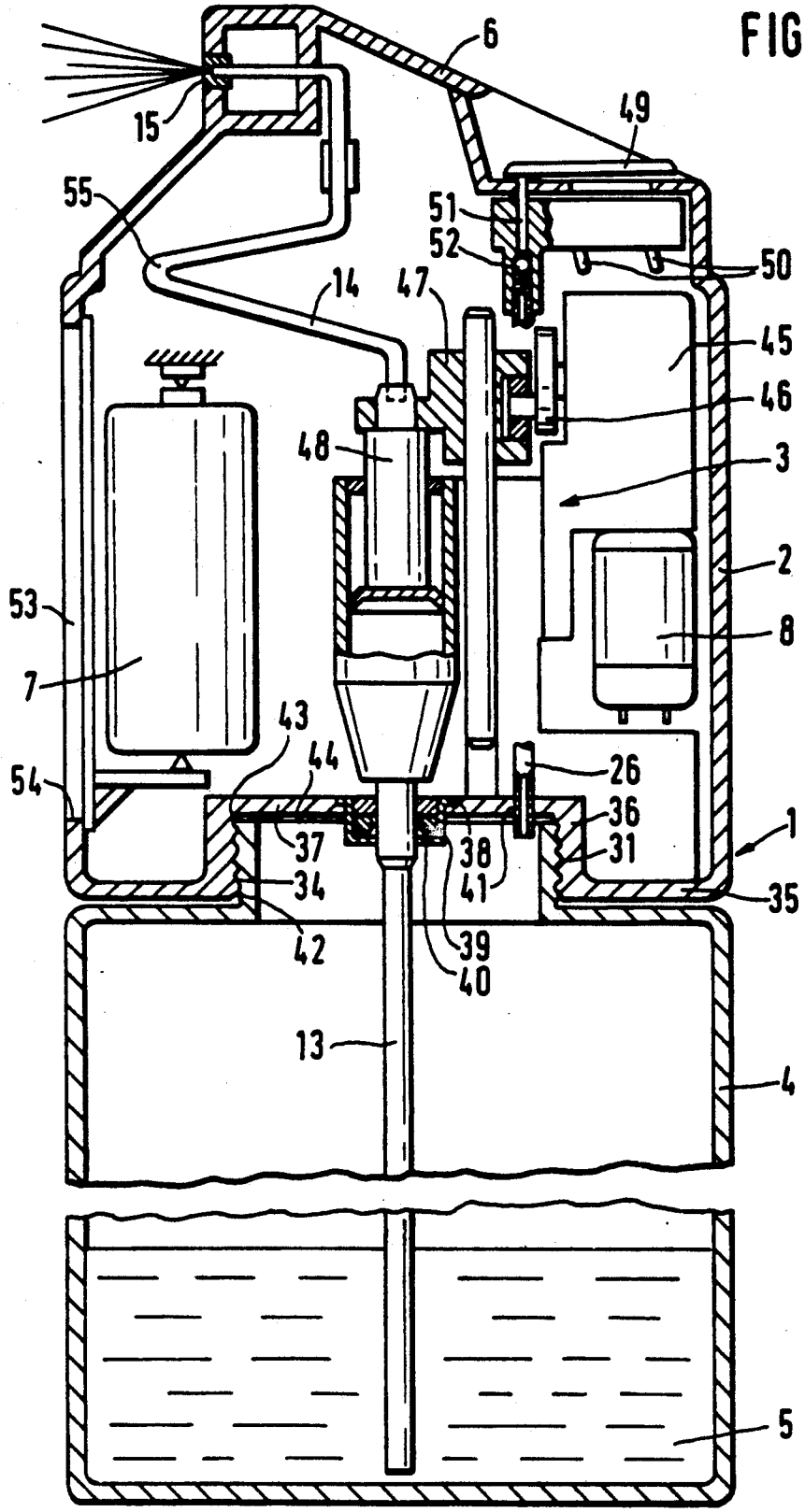
FIG. 4 illustrates schematically a sectional view through a spray container with an installed piston pump.

At its head end, the container 4 for the spray fluid 5 possesses a central annular connector 42 with an external screwthread 34. The upper opening 43, in the example pursuant to FIG. 4, is closed off by means of a thin foil 44. Instead of the foil 44 there can also be provided a removable cover of a rigid material, or a solution pursuant to FIG. 7.

The connection of the housing 2 with the container 4 is effectuated in that the housing 2, together with the spray mechanism 3, is mounted on the container 4 and screwed to the latter by means of the mating screwthreads 31 and 34. The upper foil 44 for the opening 43 is pierced through by the suction tube and the air tube 26 during the attachment of the housing 2.

Quite apparently, the types of connection for housing 2 in container 4 of FIGS. 1, 2 and 4 can be interchanged and combined with each other.

The spray mechanism 3 pursuant to FIG. 4 consists of a battery 7 having an electric motor 8 electrically connected thereto. The electric motor 8 drives an eccentric 46 through a transmission drive 45, in which the eccentric is in an operative connection through a slider 47 with the piston pump 48. Below the piston pump 48, a suction tube 13 exits, whereas in the upper portion of the piston pump 48 there is connected the helically-coiled pressure or delivery tube 14, which connects with a discharge or spray nozzle 15. The electric motor 8 is actuated by means of an electric switch 49 possessing electrical switch contacts 50. Additionally, an air tube 26 is connected with the electric switch 49, wherein the tube possesses only an extremely narrow passageway cross-section of about 2 to 5 mm. Below the electric switch 49, the air tube 26 is adapted to be closed off by means of a spring-supported valve 52 for preventing the discharge of fluid.

The insertion or, respectively, the exchange of a battery 7, is carried out through the opening in the cylinder wall of the housing 2, which can be closed off by a cover 53. Reference numeral 55 identifies the coils of the pressure tube 14 or, in essence, that of the flexible pressure or delivery line.

In the condition of the spray container or can 1 which is illustrated in FIGS. 1, 2 and 4, a spray fluid or liquid 5 can be sprayed from the nozzle 15 in the head portion 6 of the housing 2 by applying a pressure to a pushbutton. After the complete withdrawal of the spray fluid, and as needed in every intermediate stage, the supply container 4 can be removed from the housing 2. The supply container 4 can then be either be conditioned for reuse by refilling with a spray fluid 5, or conveyed to a storage. Naturally, it is possible to separate the supply container 4 when the operating person would like to withdraw a different spray fluid from another supply container with the use of the same spray mechanism. In this instance it is advisable that the upper opening 44 of the supply container 4 be provided with a sealingly or tightly closable cover.

The connection between the housing 2 and the supply container 4, as an alternative to the illustrated screwthread connection, can also be undertaken through the intermediary of a bayonet closure, plug closure or clamping closure of usual kind of construction.

Upon actuation of the electric switch 49, a pusher rod 51 opens the spring-supported air valve 52, as a result of which there is facilitated an inflow of air into the supply container as a compensation for the withdrawn fluid.

FIG. 5 illustrates the possibility of positioning the discharge nozzle 15 externally of the head portion 6 of the housing of the spray can or container 1. For this purpose, an extension tube 56 is inserted into the head portion 6, into which there connects the delivery or pressure line 14. The discharge nozzle 15 is installed on the distal or free end of the extension tube 56.

The extension tube 56, in accordance with FIG. 6, can also be constituted of a relatively lengthy either flexible or stiff conduit 57; for example, of 1 m in length. This serves the purpose of being able to spray ceilings or remote regions in living quarters, halls or the like rooms in a simple and targeted manner. In this instance, the switching of the electric motor 8 for the functioning of the pump 12 or 48 is not undertaken by means of the spray head 6 or the upper switch 49, but through a separate switch 58 in an additional operating or working grip 59 on the housing 2. From a socket plug 60 which is located in the housing or on the housing 2, an electrical line 61 is conducted, as shown in the simplified illustration, to the switch 58 in the operating grip 59. Furthermore, the electric motor 8 is connected with the switch 58 in that configuration through the electrical lines 62 whereby, upon pressing down on the switch 58, there is produced an electrical connection between the socket plug 60 and the electric motor 8. Upon the connection of the socket plug 60 with an energy source (electric plug, power supply) a current flow to the electric motor 8 which places the electric motor 8 and simultaneously the connected pump 12 (48).

The flexible or stiff pressure line 57, similar to the electrical lines 61, 62, is positioned within the operating grip 59 up to the pump 12 (48). The pressure line 57 can be configured so as to be slidable into and withdrawable from the housing 2 and the operating grip 59.

Figure 7:
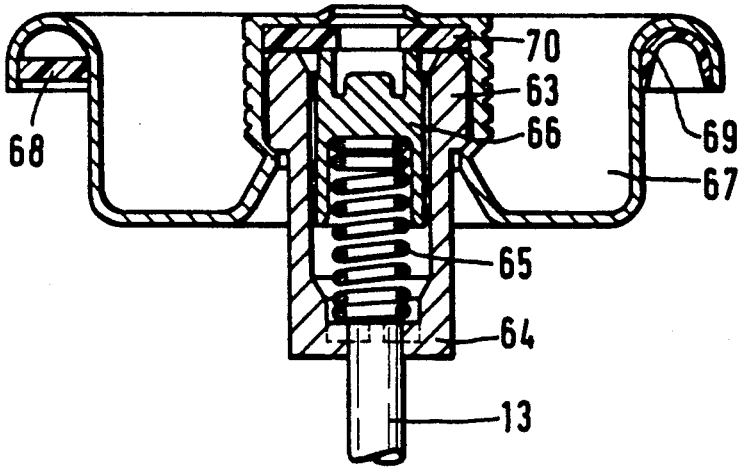
FIG. 7 illustrates a closure valve for the fluid supply container.

In order not to permit the refilling of the supply container 4 for the spray fluid 5 by unauthorized persons, so as to generally avoid any endangering and the refilling with noxious or harmful fluids or media, pursuant to FIG. 7, there is provided a special closure safety in the form of a known per se valve 63 to which there is connected the suction tube 13. This valve 63 is inserted in the cover of the supply container 4 and consists of a separate valve body 64, the valve spring 65 inserted therein, the spring pan 66, the spring plate 67 and the outer seals 68, 69, as well as the inner seals 70. Upon the screwing of the supply container 4 into the housing which is in the configuration as represented by FIGS. 1, 2 and 4, then the valve 63 is pressed downwardly opposite the force of the valve spring 65, and as a result, the valve is opened. The spray fluid 5 can then exit from the supply container.

As has been ascertained from experiments, the jet of the spray 71 can be improved during its egress from the spray container 1, when the spray fluid or liquid 5 is subjected to a slight pressure of about 0.5 to 0.8 bar. For this purpose, a pressurized gas is introduced into the supply container 4; for example, such as nitrogen, in addition to the spray fluid. By means of this pressurized gas there are also at least reduced the necessary suctioning power of the gear pump 12 or of the piston pump 8, inasmuch as the rise in the spray fluid 5 is effectuated in a pressure-supported manner.

Figure 8:
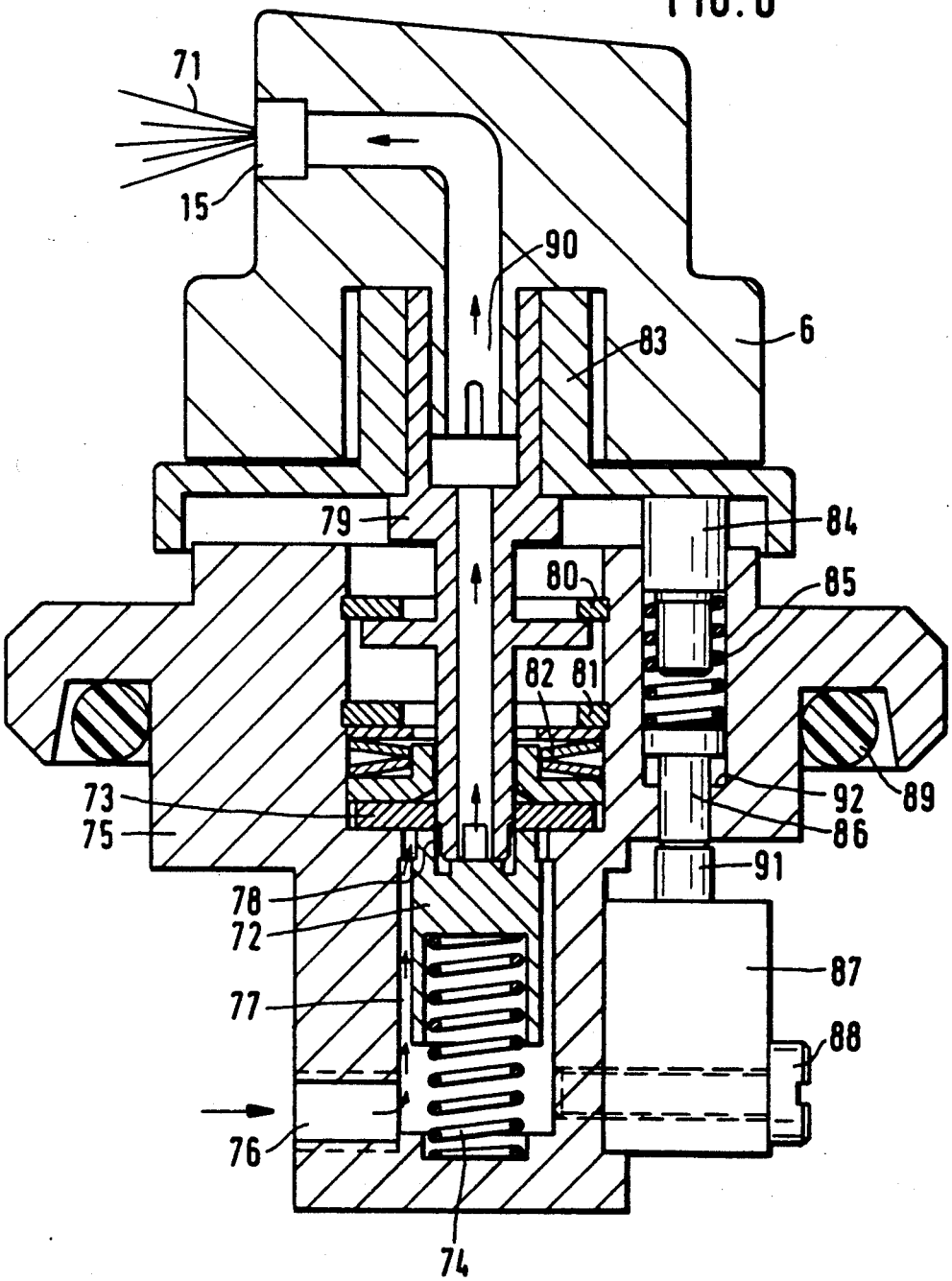
FIG. 8 illustrates, in a simplified sectional view, a valve arrangement for a spray container with utilization of a pressurized gas.

When a pressurized gas is introduced into the supply container 4, there must be prevented that the jet of the spray or, in essence, the spray fluid 5 will unintentionally exit from the discharge nozzle 15. This is prevented in that a valve 72 is installed in the head portion 6 of the housing 2, as is illustrated in FIG. 8.

The valve housing 75 is inserted into the housing 2 of the spray container 1 with a sealing ring 89 towards the lower spray mechanism 3 with the pump 12 (48).

In the valve housing 75 there is provided the inlet opening 76 for the pressure line 14. From the inlet opening 76, an annular passageway 77 which extends about the valve body 72 leads to the upper valve disc 73 which, just as well as the valve body 72, cooperates with the nozzle mounting 79. The valve body 72 stands under the action of a valve spring 74. The nozzle mounting 79 is subjected to a force by a pressure piece 83, which is operatively connected with the head portion 6 of the spray container 1, and possesses in an axially superimposed arrangement an upper contact or stop 80 and a lower contact or stop 81. Plate springs 82 are installed intermediate the lower contact stop 81 and the valve disc 3.

The pressure piece 83 acts against a switching pin or pusher 84 off-center under the biasing action of a spring 85, which stands at an axial distance relative to a pressure pin or pusher 86. The latter, in turn, is movable towards a limit switch 87, which is fastened in the valve housing 75 by means of a screw 88.

In the event that a spray jet 71 is to be produced, then the head portion 6 is depressed, acting as a switch in the usual manner. By means of the nozzle mounting 79 there is finally exerted a pressure on the valve body 72 opposite the spring pressure. The spray fluid 5 in the annular passageway 77 of the valve 72 can exit through the slit 78 into the upper delivery or pressure line 90. In order that the pump 12 (48) should already be in operation a fraction of a second prior to the opening of the discharge nozzle 15 or; in essence, prior to the opening of the valve 72, such that the spray fluid will not already exit from the nozzle 15 under the effect of the gas pressure, there must be actuated the limit switch 87, which requires a smaller displacement stroke of its switching pusher 91 than that of the valve disc 73 for the opening of the slit 78. In addition thereto, the displacement stroke of the switching pusher 91 with respect to the switching point evidences a relatively large tolerance of about ±0.3 mm. The limit switch 87 must thus already switch prior to the opening of the valve 72. This is hereby attained through the spring 85, which actuates the switch 87 by means of the switching pin or pusher 84 upon the depression of the pressure piece 83. Moreover, there is achieved that subsequent to the traversal of the maximum switching displacement stroke by the pressure pin or pusher 86, the spring 85 is essentially still further compressed; however, the pressure pin 86 comes into contact with the contact surface 92 on the valve housing 75. The pressure pin 86 can thus no longer be axially advanced, although the spring 85 is still compressed, in order to allow for the entire necessary displacement stroke of the valve 72.

What is claimed is:

1. A spray container including a spray mechanism for finely atomizing fluids through the intermediary of a hydraulically-operating pump; a housing for receiving said spray mechanism; a supply container for the spray fluid being connected with said housing by a locking closure, said spray mechanism including a gear pump, an electric motor for driving said pump, said pump having a suction line conducted through an opening in the bottom of the housing into the supply container, said container having a second opening in the bottom thereof for the through passage of an air conduit which is operatively connected with a motor switch for a motor of the spray mechanism, said opening having a cross section of about 2 to 5 mm, said container having a venting line, and said gear pump including a pressure line at the discharge end of the pump; and a fluid discharge nozzle being connected with said pressure line.

2. A spray container as claimed in claim 1, wherein said gear pump is fixedly mounted on the bottom of said housing.

3. A spray container as claimed in claim 1, wherein a coupling is connected between a drive output shaft of the motor and a drive input shaft of the gear pump.

4. A spray container as claimed in claim 1, wherein the gear pump comprises two equally-sized gears and at the discharge end thereof includes an overflow valve consisting of a spring-supported steel ball.

5. A spray container as claimed in claim 1, wherein said venting line has an outlet which is closable by a ball subjected to the biasing action of a spring, whereby a vacuum generated in the supply container upon the withdrawal of fluid overcomes the biasing force of said spring force to cause the ball to move away from the venting line outlet.

6. A spray container as claimed in claim 1, wherein the housing for the spray mechanism and the supply container for the spray fluid are each selectively constituted of plastic material, metal or glass.

7. A spray container as claimed in claim 1, wherein a pressurized gas is introduced into the supply container for the spray fluid; a flow valve in the upper portion of the housing for the passage therethrough of the spray fluid under pressure for discharge from the supply container, said valve being coupled with an axial movement of a head portion for purposes of a switching movement, and which in combination with a switch mechanism of a limit switch is effective for the actuation of the electric motor of the pump such that the limit switch is actuated a short time prior to the opening of the valve and the switch mechanism assumes the entire opening displacement stroke of the valve in response to a biasing spring force and controllably transmits said stroke to the limit switch.

8. A spray container including a spray mechanism for finely atomizing fluids through the intermediary of a hydraulically-operating pump, a housing for receiving said spray mechanism; a supply container for the spray fluid being connected with said housing by a locking closure, said spray mechanism including a piston pump, an electric motor for driving said pump, said pump having a suction line conducted through an opening in the bottom of the housing into said supply container, said container having a second opening in the bottom thereof for the through passage of an air conduit which is operatively connected with a motor switch for a motor of the spray mechanism, said opening having a cross section of about 2 to 5 mm, said piston pump including a pressure line at the discharge end of said pump; and a fluid discharge nozzle being connected with said pressure line.

9. A spray container as claimed in claim 1 or 8, comprising means for sealing the opening in the bottom of said housing.

10. A spray container as claimed in claim 1 or 8, wherein said pressure line includes with a helically-coiled portion extending through a helix angle of at least 180°.

11. A spray container as claimed in claim 1 or 8, wherein said pressure line is extended outwardly of said housing, and said fluid discharge nozzle is connected with outer free end of said pressure line.

12. A spray container as claimed in claim 11 wherein at least the portion of the pressure line which located externally of said container comprises a flexible conduit.

13. A spray container as claimed in claim 12, wherein said housing includes an operating grip, said flexible conduit being at least partially conducted within said grip; and a switch on said grip which is electrically connected with an energy source and with said electric motor for the drive of said pump.

14. A spray container as claimed in claim 1 or 8, wherein a screwthread is provided in the bottom portion of said housing, said screwthread being engageable with a screwthread formed in the head portion of the fluid supply container.

15. A spray container as claimed in claim 1 or 8, wherein the bottom portion of the housing is connectable with the head portion of the supply container through a bayonet, socket or clamping connection.

16. A spray nozzle as claimed in claim 1 or 8, wherein said suction line is conducted through the opening in the bottom of the housing, and which bottom includes a housing seal annularly encompassing the suction line.

17. A spray container as claimed in claim 1 or 8, wherein a detachable cover is arranged at the head end of said supply container, said cover consisting of a deformable material which is pushed open or torn apart under the action of a force imparted thereto.

* * * * *